United States Patent [19]

Akizuki et al.

[11] Patent Number: 4,754,191

[45] Date of Patent: Jun. 28, 1988

[54] ELECTRON LENS SYSTEM FOR DEFLECTION AMPLIFICATION IN A CATHODE-RAY TUBE

[75] Inventors: Osamu Akizuki, Hino; Takefumi Kato, Tokyo, both of Japan

[73] Assignee: Iwatsu Electric Co., Ltd., Tokyo, Japan

[21] Appl. No.: 39,522

[22] Filed: Apr. 16, 1987

[30] Foreign Application Priority Data

| | | | |
|---|---|---|---|
| Apr. 17, 1986 | [JP] | Japan | 61-88732 |
| Apr. 17, 1986 | [JP] | Japan | 61-88733 |
| Jan. 12, 1987 | [JP] | Japan | 62-4464 |

[51] Int. Cl.[4] ..... H01J 29/80; H01J 29/70

[52] U.S. Cl. ..... 313/429; 313/432; 315/17

[58] Field of Search ..... 313/429, 432, 434, 435, 313/436, 449, 460, ; 315/17

[56] References Cited

U.S. PATENT DOCUMENTS

| | | | |
|---|---|---|---|
| 4,302,704 | 11/1981 | Saito | 315/17 |
| 4,543,508 | 9/1985 | Saito | 313/429 |
| 4,614,895 | 9/1986 | Saito et al. | 313/429 |
| 4,623,819 | 11/1986 | Janko et al. | 313/432 |

FOREIGN PATENT DOCUMENTS 6065436 6/1968 Japan .

*Primary Examiner*—David K. Moore
*Assistant Examiner*—K. Wieder
*Attorney, Agent, or Firm*—Woodcock Washburn Kurtz Mackiewicz & Norris

[57] ABSTRACT

A generally box-shaped electron lens system for use in an oscilloscopic or storage cathode-ray tube for the amplification of both vertical and horizontal deflections of the electron beam from the gun to the target of the CRT. The lens system comprises two electrodes at least partly displaced from each other along the CRT tube axis, with a gap therebetween for electrically insulating one from the other. A pair of tongues extend either from the gun-side electrode into the target-side electrode, or from the target-side electrode into the gun-side electrode, or two such pairs of tongues extend from both electrodes into interdigitating relation to each other. Upon application of prescribed potentials to the two electrodes, a quadrupolar lens field is created in the space between the pair or pairs of tongues for deflection amplification in both directions. On having been deflected vertically, the beam has its deflection amplified by having its traveling direction inverted with respect to the tube axis. The beam that has been deflected horizontally has its deflection magnified without having its traveling direction inverted.

16 Claims, 18 Drawing Sheets

ELECTRON LENS SYSTEM FOR DEFLECTION AMPLIFICATION IN A CATHODE-RAY TUBE

BACKGROUND OF THE INVENTION

Our invention relates generally to cathode-ray tubes (CRTs) and more particularly to those of the type incorporating a "meshless" electron lens system, commonly referred to as the scan expansion or deflection amplification lens system, for expanding the deflections of the electron beam in both vertical and horizontal directions. Still more particularly, our invention deals with an improved scan expansion lens system of generally boxlike, two-electrode configuration for high-speed CRTs for both oscilloscopic and information storage use, among other application.

The meshless scan expansion lens systems of various known configurations have almost superseded the more conventional fine-metal, dome-shaped mesh lens in today's high-performance CRTs. Each such meshless lens system comprises several lens elements of electrodes positioned in alignment about the tube axis of the CRT so as to encompass the trajectors of the electron beam from the deflection fields to the target.

We know some prior art meshless lens systems, examples being those disclosed in Japanese Laid Open Patent Applications Nos. 59-134531, 60-65436 and 60-23939 and U.S. Pat. No. 4,302,704 to Saito. The lens system suggested by the first mentioned reference is very complex in construction, comprising two nested cylindrical electrodes, a slot lens at the beam entrance end of the electrodes, and an aperture lens at their exit end. The other three references are alike in teaching the use of boxlike lens elements configured to provide quadrupolar lens actions. We prefer boxlike lens systems because of their simplicity of construction and ease of fabrication.

The current trend in the design of CRTs, however, is the reduction of their size, particularly of their axial dimension. This objective demands, of course, the advent of a meshless lens system of smaller axial length.

SUMMARY OF THE INVENTION

We have hereby invented a meshless scan expansion lens system of novel design which has a smaller axial dimension than heretofore and which, nevertheless, has very high deflection sensitivities.

Our invention may be summarized as apparatus including a cathode ray tube having a target, an electron gun for emitting a beam of electrons normally directed along a z-axis toward the target, deflection means disposed between the target and the electron gun for deflecting the beam in direction of x- and y-axes which are at right angles with each other and with the z-axis, and a scan expansion lens system disposed between the deflection means and the target for amplifying the deflections of the beam.

Stated in its simplest form, the scan expansion lens system comprises first and second tubular electrodes of substantially rectangular cross sectional shape disposed in alignment with respect to the z-axis to allow the passage of the beam therethrough and at least partly displaced from each other along the z-axis. The first electrode has a first pair of opposite sides which are symmetrical with respect to an xz-plane determined by the x- and z-axes, and a second pair of opposite sides which are symmetrical with to a yz-plane determined by the y- and z-axes. The second electrode having a first pair of opposite sides which are symmetrical with respect to the xz-plane, and a second pair of opposite sides which are symmetrical with respect to the yz-plane. At least either of the first pair of opposite sides of the first electrode and the second pair of opposite sides of the second electrodes have extensions protruding therefrom toward the other of the first and second electrodes to provide a pair of tongues. Each of the spacing between the first pair of opposite sides of the first electrode as measured on the yz-plane and the spacing between the second pair of opposite sides of the second electrode as measured on the xz-plane is in the range of 80 to 120 percent of the other.

Also included in the apparatus of our invention are means for applying prescribed electric potentials to the first and second electrodes of the lens system. The prescribed potentials are such that the electron beam on being deflected by the deflection means in one of the x-and y-axis directions has its deflection amplified by having its traveling direction inverted with respect to the z-axis by a quadrupolar lens action of the first and second electrodes, whereas the electron beam on being deflected in the other of the x- and y-axis directions has its deflection amplified by the quadrupolar lens action without having its traveling direction inverted.

The foregoing summary of our invention will be better understood by considering the construction of one preferred embodiment disclosed herein. The first electrode is disposed closer to the gun than is the second electrode and so is referred to as the gun-side electrode, the second electrode being referred to as the target-side electrode. The gun-side electrode has the pair of tongues formed by extensions from its first pair of opposite sides into the target-side electrode. The pair of tongues of the gun-side electrode and the second pair of opposite sides of the target-side electrode define in combination a space in which is created a quadrupolar lens field for deflection amplification.

As has been set forth in the foregoing summary, the spacing between the first pair of opposite sides of the gun-side electrode, and therefore between the pair of tongues protruding therefrom, is from 80 to 120 percent (preferably 100 percent) of the spacing between the second pair of opposite sides of the target-side electrode. Accordingly, upon application of the prescribed voltages to the two electrodes, hyperbolic equipotentials are so distributed in the noted space as to provide a nearly ideal quadrupolar lens field for deflection amplification by a divergent lens action in the x-axis direction and a convergent lens action in the y-axis direction. The lens actions in both directions are so strong that the lens system can be of minimal dimension along the z-axis for given degrees of deflection amplification.

According to a further feature of our invention, the pair of tongues extending from the gun-side electrode have a pair of protuberances on their opposed surfaces, each protuberance being elongated along the x-axis. These protuberances serve to enhance the quadrupolar lens action for still higher degrees of scan expansion.

An additional further feature of our invention resides in an apertured end plate closing the target-side end of the traget-side electrode. The shape of the aperture in the end plate, through which the electron beam emerges from the lens system, can be determined for minimal image distortion on the target screen.

The above and other features and advantages of our invention will become more apparent, and the invention itself will best be understood, from a study of the following description and appended claims, with reference had to the attached drawings showing some preferred embodiments of the invention.

DESCRIPTION OF THE PREFERRED EMBODIMENTS

CRT Configuration

Figure 1:
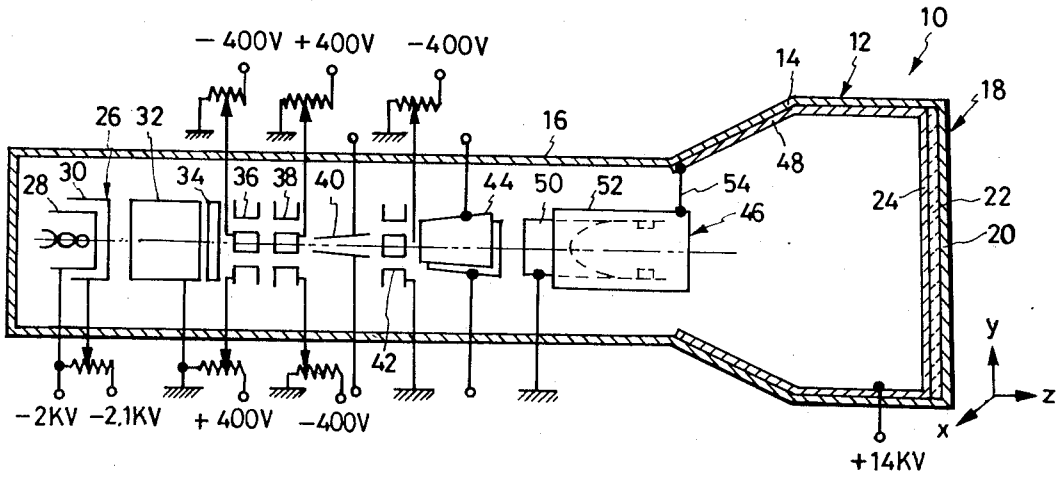
FIG. 1 is a diagrammatic longitudinal section through a typical example of CRT to which our invention finds application, the CRT being shown with a preferred form of the scan expansion lens system of our invention mounted in place therein.

We will now describe our invention in detail as embodied in the post-acceleration CRT for oscilloscopic applications shown in FIG. 1. Generally designated 10, the exemplified CRT has an evacuated envelope 12 of glass or other suitable insulating material. The envelope 12 comprises a funnel portion 14 and a tubular neck portion 16 which are molded in one piece and in axial alignment. The funnel portion 14 has a target 18 on its front end, shown directed to the right in FIG. 1. The target 28 is herein shown as a fluorescent screen comprising a faceplate 20, a phosphor coating 22 behind the faceplate, and a conductive coating 24 further behind the phosphor layer.

The neck portion 16 of the vacuum envelope 12 has an electron gun 26 mounted therein adjacent its end away from the target 18. The electron gun 26 conventionally comprises a cathode 28, control grid 30 and anode 32. Disposed axially of the envelope neck portion 16, the electron gun 26 generates and emits a beam of electrons toward the target 18. Normally, that is, when not deflected, the beam travels along the axis of the vacuum envelope 12 from gun 26 to target 18.

On its way from gun 26 to target 18 the electron beam traverses an aberration correction lens system 34, first and second quadrupolar lens systems 36 and 38, a pair of vertical deflection plates 40, a third quadrupolar lens system 42, a pair of horizontal deflection plates 44, and a scan expansion lens system 46, in that order. All these components 34–46, except a target-side end portion of the scan expansion lens system 46, are disposed in the envelope neck portion 16. The CRT 10 further comprises a postdeflection electrode 48, herein shown as an accelerating electrode in the form of a conductive coating on the inside surface of the envelope funnel portion 14. The postdeflection electrode 14 is electrically connected to the conductive layer 24 of the target 28.

The scan expansion lens system 46 forms the gist of our invention. We will later describe its construction and operation in detail in terms of its several preferred forms. Suffice it to say for the moment that is comprises two electrodes 50 and 52, with the first electrode 50 grounded and the second electrode 52, having its target-side end portion surrounded by the postdeflection electrode 48, electrically coupled thereto via a line 54.

The target 18, electron gun 26, aberration correction lens system 34, quadrupolar lens systems 36, 38 and 42, vertical and horizontal deflection systems 40 and 44, and postaccelerating electrode 48 of the illustrated CRT 10 can each be of known design and, as a whole, of standard arrangement. We will therefore give no more detailed description of these familiar CRT components. Our invention particularly features the scan expansion lens system 46 and its structural and functional relations with the other CRT components.

Typical values of potentials that may be applied to the various electrodes of the CRT 10 may be: −2000 V to the cathode 28 of the electron gun 26; −2100 to −2000 V to the gun control grid 30; 0 V (ground potential) to the gun anode 32; −50 to +50 V to the aberration correction lens system 34; −400 to +400 V to the quadrupolar lens systems 36, 38 and 42; 0 V (ground potential) to the first electrode 50 of the scan expansion lens system 46; and 14000 V to the second electrode 52 of the scan expansion lens system 46 and to the postaccelerating electrode 48.

Before explaining the operation of the CRT 10 we wish to point out that the terms "vertical" and "horizontal", as used previously to describe the deflection systems 40 and 44, are conventional and do not necessarily imply that the beam is deflected vertically and horizontally in the strict senses of the words. All that is required, of course, is that the two deflection systems deflect the beam in two orthogonal directions that are further at right angles with the axis of the CRT envelope 12. We will therefore adopt the expressions "x-axis", "y-axis" and "z-axis" to expedite directional explanations. The x-axis and y-axis represent the two orthogonal directions of beam deflection and so may extend, for example, horizontally and vertically, respectively, according to the conventional usage of the words. The z-axis extends in the axial direction of the CRT envelope 12 and so represents the traveling direction of the undeflected electron beam. We will further refer to the plane determined by the x- and y-axes as the xy-plane, to the plane determined by the x- and z-axes as the xz-plane, and to the plane determined by the y- and z-axes as the yz-plane.

Except for the scan expansion lens system 46 the CRT 10 operates conventionaly to produce a visible pattern of the input signal on the target 18. The control grid 30 controls the emission of electrons from the cathode 28. The electrons emitted in a beam traverse the anode 32 and aberration correction lens system 34 and enter the first quadrupolar lens system 36. This lens system 36 functins to converge the electron beam in the xz-plane and to diverge the beam in the yz-plane. The second quadrupolar lens system 38 functions to diverge the beam in the xz-plane and to converge the beam in the yz-plane. The third quadrupolar lens system 42 functions to converge the beam in the xz-plane and to diverge the beam in the yz-plane. The vertical deflection system 40 operates to deflect the beam in the y-axis direction in response to the vertical deflection signal (input signl to be displayed) supplied thereto. The horizonta deflection system 44 operates to deflect the beam in the x-axis direction in response to the ramp (sweep) signal fed from the known sweep circuit, not shown.

Although the operation of the scan expansion lens system 46 in accordance with our invention will be detailed later, we will briefly explain such operation as follows. The lens system 46 converges the beam in the yz-plane and diverges the beam in the xz-plane. It amplifies the deflections of the beam in both x- and y-axes directions so as to provide full coverage ofthe target 18. On having been deflected in the y-axis direction, in particular, the beam has its traveling direction inverted with respect to the z-axis by the intense convergent action of the lens system 46. The second electrode 52 of the lens system 46, to which the same high voltage is being applied as to the postaccelerating electrode 48, performs the additional function of accelerating the electrons for the higher brightness of the image on the target screen 18.

Scan Expansion Lens System

Figure 2:
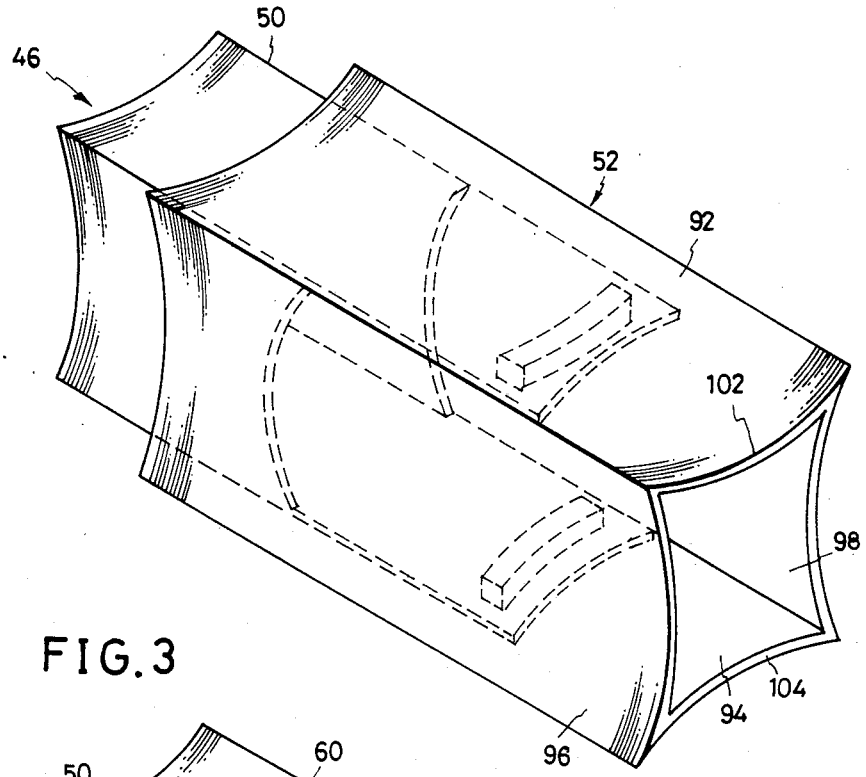
FIG. 2 is an enlarged perspective view of the lens system used in the CRT of FIG. 1.

We have illustrated the scan expansion lens system 46 in detail in FIGS. 2–8. As shown in FIG. 2, the lens system 46 comprises the two electrically insulated tubular or boxlike electrodes or lens elements 50 and 52 disposed in alignment with each other about the z axis to allow the passage of the electron beam therethrough. The first or gun-side electrode 50 is partly nested in the second or target-side electrode 52 in this particular embodiment.

Figure 3:
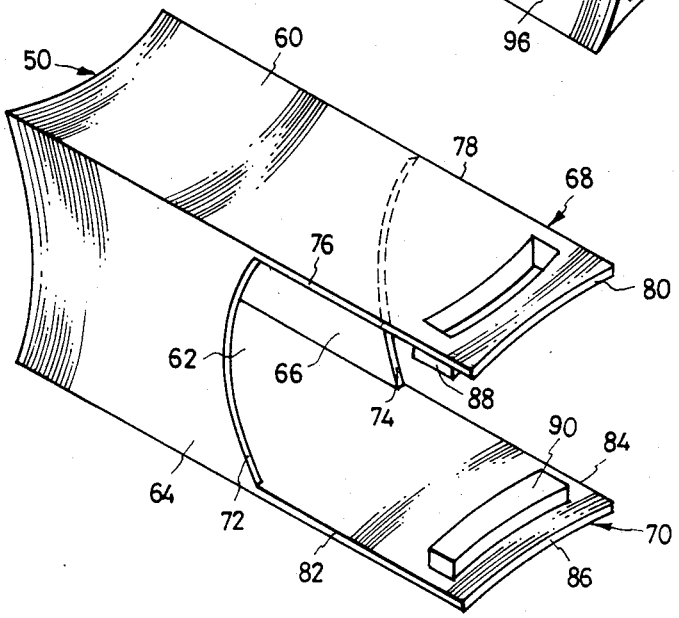
FIG. 3 is a perspective view of the gun-side electrode of the lens system.

As illustrated in detail in FIG. 3, the gun-side electrode 50 has a first pair of opposite sides 60 and 62 which are symmetrical with respect to the xz-plane, and a second pair of opposite sides 64 and 66 which are symmetrical with respect to the yz-plane. The two pairs of opposite sides 60–66 are combined into rectangular cross sectional shape. The axial dimension of the first pair of opposite sides 60 and 62 is longer than that of the second pair of opposite sides 64 and 66, so that the first pair of opposite sides can be thought of as having a pair of tongues 68 and 70 protruding in coplanar relation therefrom toward the target, or toward the target-side electrode 52, beyond the target-side ends 72 and 74 of the second pair of opposite sides 64 and 66.

The tongue 68 has a pair of side edges 76 and 78 extending linearly along the z-axis, and an end 80 directed toward the target. The end 80 of the tongue 68 is curved in an arc that is convex toward the gun, with a view to distortionless image display. The other tongue 70 likewise comprises a pair of side edges 82 and 84 extending linearly along the z-axis, and an end 86 directed toward the target. This end 86 is also curved in an arc that is convex toward the gun for distortionless image display. For the same purpose the target-side ends 72 and 74 of the second pair of opposite sides 64 and 66 are each curved in an arc that is convex toward the gun. Cross-sectionally, all the four sides 60–66 of the gun-side electrode 50 are curved in arcs that are convex toward the z-axis, in order to realize an approximately ideal hyperbolic equipotentials field to be set forth presently.

The pair of tongues 68 and 70 of the gun-side electrode 50 are formed to include a pair of opposed protuberances 88 and 90, respectively, which project toward the z axis and which are each elongated along the x-axis. The protuberances 88 and 90 are disposed adjacent the target-side ends 80 and 86, respectively, of the tongues 68 and 70. In practice these protuberances may be formed by the pressing of the sheet metal of which the electrode 50 is made.

With reference back to FIG. 2 the target-side electrode 52 comprises a first pair of opposite sides 92 and 94 which are symmetrical with respect to the xz-plane, and a second pair of opposite sides 96 and 98 which are symmetrical with respect to the yz-plane. All of the same axial dimension, the two pairs of opposite sides 92–98 are combined into substantially rectangular cross-sectional shape. The target-side electrode 52 envelopes a target-side end portion, inclusive of all of the tongues 68 and 70, of the gun-side electrode 50 with a sufficient gap therebetween to electrically insulate them from each other. Cross-sectionally, all the four sides 92–98 of the target-side electrode 52 are also curved in arcs that are convex toward the z-axis.

Figure 4:
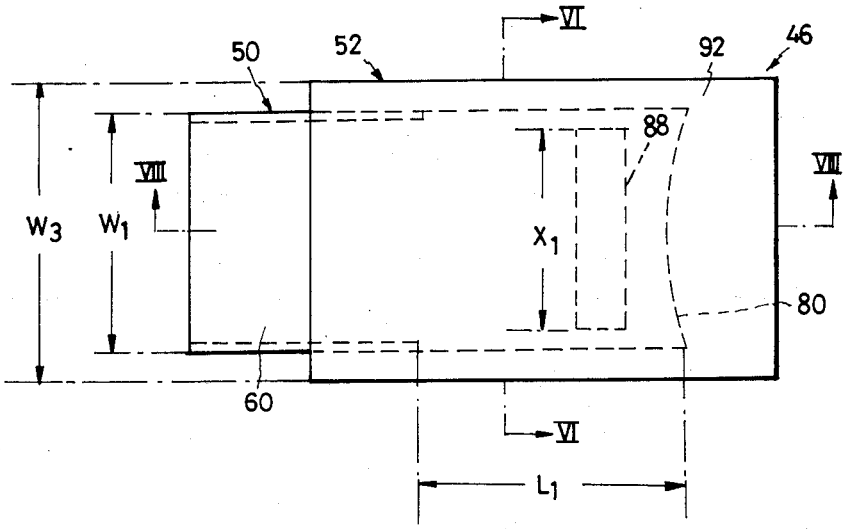
FIG. 4 is a top plan view of the lens system, the view being explanatory of the relative dimensions of the two electrodes of the lens system.
Figure 5:
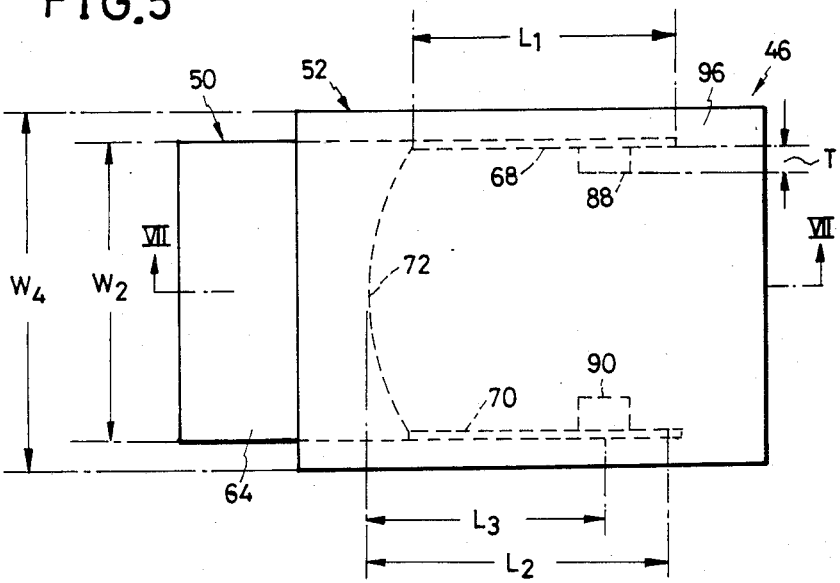
FIG. 5 is a side elevation of the lens system, the view being also explanatory of the relative dimensions of the lens system.

We will now refer to FIGS. 4 and 5 for the discussion of the pertinent dimensional specifications of the scan expansion lens system electrodes 50 and 52. The width W1 (dimension along the x-axis) of the first pair of opposite sides 60 and 62 of the gun-side electrode 50 is less than the width W2 (dimension along the y axis) of its second pair of opposite sides 64 and 66. The width W3 (dimension along the x-axis) of the first pair of opposite sides 92 and 94 of the target-side electrode 52 is less than the width W4 (dimension along the y-axis) of its second pair of opposite sides 96 and 98. The width W2 of the second pair of opposite sides 64 and 66 of the gun-side electrode 50 is approximately equal to the width W3 of the first pair of opposite sides 92 and 94 of the target-side electrode 52.

We recommend that, in order to preclude the possibility of electric discharge between the two electrodes 50 and 52, the width W4 of the second pair of opposite sides 96 and 98 of the target-side electrode 52 should be greater than the width W2 of the second pair of opposite sides 64 and 66 of the gun-side electrode 50 by more than 6 mm. The width W3 of the first pair of opposite sides 92 and 94 of the target-side electrode 52 should be greater than the width W1 of the first pair of opposite sides 60 and 62 of the gun-side electrode 50 by 6 mm or more. Thus the preferred dimensions are: W1=16 mm, W2=20 mm, W3=24 mm, and W4=28 mm.

Figure 6:
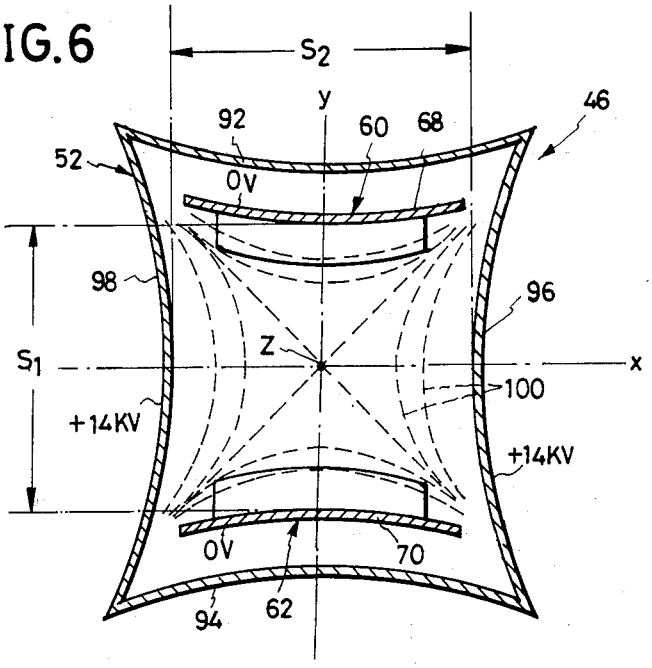
FIG. 6 is a cross section through the lens system, taken along the line VI—VI in FIG. 4 and showing in particular the quadrupolar lens field created therein upon application of prescribed voltages to the two electrodes of the lens system.

Of particular significance for the provision of the ideal field of hyperbolic equipotentials 100, FIG. 6, are the dimensions S1 and S2 indicated in the same figure. S1 is the spacing, as measured on the yz-plane, between the first pair of opposite sides 60 and 62, and therefore between the pair of tongues 68 and 70, of the gun-side electrode 50. S2 is the spacing, as measured on the xz-plane between the second pair of opposite sides 96 and 98 of the target-side electrode 52.

Desirably, the spacings S1 and S2 should be exactly equal in order to realize the ideal field of hyperbolic equipotentials 100 as in FIG. 6. However, we have ascertained from experiment that a nearly ideal quadrupolar lens field results if $$S2-0.2\cdot S2 \leqq S1 \leqq S2+0.2\cdot S2, \text{ or}$$

$$S1-0.2\cdot S1 \leqq S2 \leqq S1+0.2\cdot S1.$$

In other words, each of the spacings S1 and S2 should be in the range of from about 80 to 120 percent of the other.

The curvatures of the four sides 60–66 of the gun-side electrode 50 and of the four sides 92–98 of the target-side electrode 52 may be so determined as to obtain, in the space between the pair of tongues 68 and 70, the equipotential field of the right-angular hyperbolic equation, $x^2-y^2=a^2$.

We have discovered that the curvature of the ends 80 and 86 of the tongues 68 and 70 of the gun-side electrode 50 affect image formation on the target screen in accordance with a definite rule. If these ends 80 and 86 are concave, image lines parallel to the x-axis will tend to suffer "barrel distortion". If they are convex, on the other hand, then the resulting image lines parallel to the x-axis will tend to suffer "pincushion distortion". The "barrel" distortion is so named because the image of a square appears barrel-shaped. The pincushion distortion is such that all four sides of the screen display are concave.

Also, as the concavities of the tongue ends 80 and 86 are made deeper, the deflection factor in the x-axis direction will become nonlinear, with the angle of beam deflection increasing at higher deflection voltages. It is possible to eliminate the distortion of image lines parallel to the x-axis by appropriate determination of the degree of concavity of the tongue ends 80 and 86. Such image lines will suffer barrel distortion if the concavity is made deeper. The shape of the tongue ends 80 and 86 also affects image lines in the y-axis direction, only to such an extent that the resulting image distortions are negligible compared with those caused by the shape of the target-side ends 72 and 74 of the second pair of opposite sides 64 and 66 of the gun-side electrode 50, as explained in detail hereafter.

The target-side ends 72 and 74 of the second pair of opposite sides 64 and 66 of the gun-side electrode 50 should be concave, that is, curved in arcs that are convex toward the gun, for minimal image distortion. The curvature of these ends 72 and 74 is related both to the distortion of image lines in the y-axis direction and to the linearity of deflection factors in both x- and y-axes directions. Image lines in the y-axis direction will suffer barrel distortion, and the deflection sensitivities in both directions will become too high at relatively high deflection voltages, if the ends 72 and 74 are concaved with a variety of curves such as parabolic, hyperbolic and $y^n$ curves and if the midportions of these ends are made deeper than their opposite end portions. The same results will also be obtained if the ends 72 and 74 are concaved to a greater depth.

In FIGS. 4 and 5, L1 denotes the length (dimension in the z-axis direction) of each of the lateral edges 76, 78, 82 and 84 of the tongues 68 and 70 of the gun-side electrode 50. In FIG. 5, L2 denotes the distance in the z-axis direction between the target-side extremities of the lateral edges 76, 78, 82 and 84 of the tongues 68 and 70 and the midpoints, in the y-axis direction, of the target-side ends 72 and 74 of the second pair of opposite sides 64 and 66 of the gun-side electrode 50. We have found that these dimensions L1 and L2 of the gun-side electrode 50 affect the intensity of the quadrupolar lens offered by this scan expansion system 46. The greater the dimensions L1 and L2, the stronger will be both the divergent lens action in the x-axis direction and the convergent lens action in the y-axis direction, resulting in the improvement of deflection sensitivities in both directions.

However, the dimension L1 of the gun-side electrode tongues 68 and 70 also affects the linearity of the deflection factor in the y-axis direction. The shorter the dimension L1, the higher will be the deflection sensitivity in the y-axis direction at relatively high deflection voltages, and vice versa. The dimension L1 must therefore be determined with this fact in mind. Experiment has proved that the linearity of the deflection factor in the y-axis direction improves by making the dimension L2 equal to W2 plus or minus W2/5.

In short, in this scan expansion lens system 46, the gun-side electrode 50 should be designed in consideration of the following three relations between the electrode geometries or dimensions and the display characteristics:

1. The length of the pair of tongues 68 and 70 in the z-axis direction affects the linearity of the deflection factor in the y-axis direction.

2. The shape of the ends 80 and 86 of the tongues 68 and 70 affects both the distortion of image lines in the x-axis direction and the linearity of the deflection factor in the same direction.

3. The shape of the target-side ends 72 and 74 of the second pair of opposite sides 64 and 66 affects the distortion of image lines in the y-axis direction.

The shape of the target-side ends 72 and 74 of the second pair of opposite sides 64 and 66 also affects the linearity of the deflection factor in the x-axis direction, only to a negligible degree, however, in comparison with the extent to which the pair of tongues 68 and 70 affects the linearity of the deflection factor in the x-axis direction. A change in the linearity of the y-axis deflection factor due to a change in the shape of the target-side ends 72 and 74 of the second pair of opposite sides 64 and 66 can be compensated for by amending the length L1 of the tongues 68 and 70.

It is therefore possible to eliminate image distortions in both x- and y-axes directions, and to optimize the linearity of deflection factors in both directions, if either of the image distortion in the x-axis direction and the linearity of the deflection factor in the x-axis direction can be controlled within significantly affecting the other. Such optimization is possible in this lens system 46 by appropriately setting the ratio W2/W1 because the greater this ratio, the lower becomes the x-axis deflection sensitivity at high deflection voltages without correspondingly distorting the image in the x-axis direction.

The configuration of the second electrode 52 also influeces, of course, image distortions and deflection factors. Generally, with an increase in the distance between the target-side extremities of the tongues 68 and 70 of the gun-side electrode 50 and the target-side ends 102 and 104, FIG. 2, of the first pair of opposite sides 92 and 94 of the target-side electrode 52, the image tends to suffer barrel distortions in both x- and y-axes directions, and the deflection sensitivities in both directions become higher at high deflection voltages. The same results are also obtained when the target-side ends 102 and 104 of the first pair of opposite sides 92 and 94 are convexed toward the target. The results are opposite when the ends 102 and 104 are concaved.

We have specified the potential of 14,000 V (16,000 V with respect to the cathode potential) for applicatin to both the target-side electrode 52 of the scan expansion lens system 46 and the postaccelerating electrode 48. An application of higher potentials to both electrodes 48 and 52 will result in the improvement of deflection sensitivities in both x- and y-axes directions. However, the deflection sensitivities in both directions will become lower at high deflection voltages, and image lines along the x-axis will suffer barrel distortion whereas image lines along the y-axis will suffer pincushion distortion.

Figure 7:
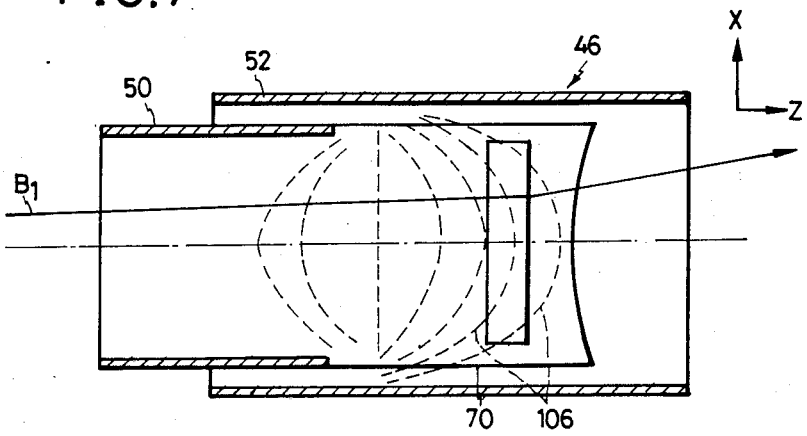
FIG. 7 is a longitudinal section through the lens system, taken along the line VII—VII in FIG. 5 and showing in particular the divergent lens action of the lens system in the horizontal or x-axis direction.

FIG. 7 is explanatory of the deflection-amplifying action of the scan expansion lens system 46 in the x-axis direction. The gun-side electrode 50 provides the divergent lens action in the xz-plane due to the distribution of equipotentials 106. Therefore, on being deflected in the x-axis direction, the beam B1 has its deflection amplified by the gun-side electrode 50.

Figure 8:
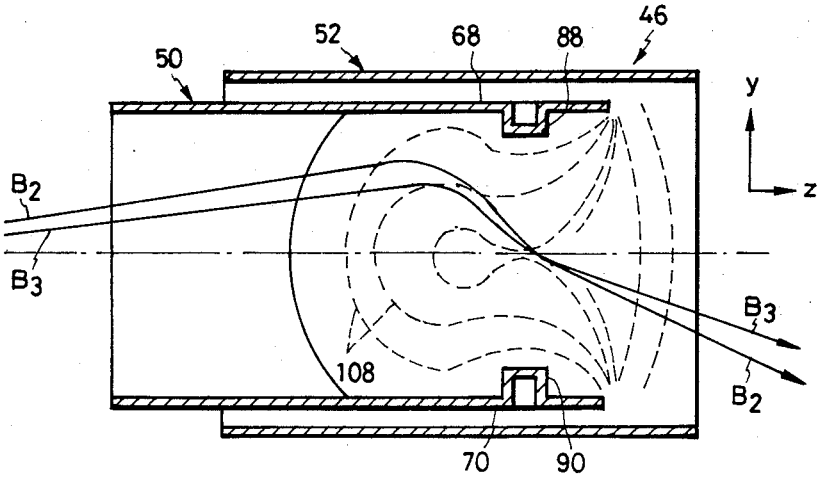
FIG. 8 is a longitudinal section through the lens system, taken along the line VIII—VIII in FIG. 4 and showing in particular the convergent lens action of the lens system in the vertical or y-axis direction.

FIG. 8 is an illustration of the deflectionamplifying action of the scan expansion lens system 46 in the y-axis direction. Equipotentials are distributed as at 108 on the yz-plane. Consequently, as indicated at B2 and B3, the electron beam on being deflected in the y-axis direction is subjected to the convergent lens action which is so intense that the beam has its traveling direction altered, or inverted, across the xz-plane. This change or inversion of the traveling direction of the beam is of such a great angle that the beam deflection in the y-axis direction is amplified.

An inspection of FIG. 8 will show that the beam crosses the xz-plane in the space between the pair of tongues 68 and 70 of the gun-side electrode 50. We attribute this strong convergent lens action to the length L1, FIG. 5, of the tongues 68 and 70. If the beam crosses the xz-plane in the space between the tongues 68 and 70, the beam will be exposed to convergent action even after crossing the xz-plane. The greater the angle through which the beam has been deflected in the y-axis direction, the greater will be the convergent action after the beam has crossed the xz-plane. Consequently, the deflection sensitivity in the y-axis direction will become lower at high deflection voltages; in other words, the linearity of the deflection factor in that direction will improves through proper determination of the length of the tongues 68 and 70.

As will be noted by referring back to FIG. 6, the space between the pair of tongues 68 and 70 is additionally bounded by the second pair of opposite sides 96 and 98 of the target-side electrode 52. The space under consideration is thus defined by the tongues 68 and 70 of ground potential (2000 V with respect to the cathode potential) and the sides 96 and 98 of +14,000 V (16,000 V with respect to the cathode potential). The spacing between the tongues 68 and 70 along the y-axis is equal to the spacing between the sides 96 and 98 along the x-axis. It will therefore be seen that the ideal quadrupolar lens field is created in this space, as indicated by the equipotentials 100.

Thus, among the advantages offered by the lens system 46 is the fact that, taken cross-sectinally as in FIG. 6, most of the space bounded by the pair of tongues 68 and 70 and the pair of opposite sides 96 and 98 can be effectively used for the quadrupolar lens action. Let Wx and Wy be the x- and y-axes dimensions, respectively, of the effective lens field of this scan expansion lens system 46. Then the ratio Wx/W1 is 0.5, and the ratio Wy/W2 is 0.85, both far higher than those of the comparable prior art devices set forth earlier in this specification.

Let us now study the functions of the elongate protuberances 88 and 90 on the opposed surfaces of the tongues 68 and 70. As will be noted from FIG. 8, these protuberances 88 and 90 serve to produce the equipotentials 108 which are constricted between these protuberances and which diverge apart on their gun side, contributing to the provision of the strong quadrupolar lens action of this lens system 46. An experimental CRT model constructed in accordance with the teachings of FIGS. 1–8 exhibited a vertical deflection sensitivity of 2.7 V/cm and a horizontal deflection sensitivity of 1.8 V/cm.

We have further ascertained that the geometries and placements of te protuberances 88 and 90 affect the overall scan expansion rates and the linearity of nonlinearity (degree of pincushion or barrel distortion) of the deflection factors.

Thus, with reference to FIG. 5, the distance L3 along the z-axis between the midpoint of each of the target-side ends 72 and 74 of the gun-side electrode 50 in the y-axis direction and the midpoint of each of the protuberances 88 and 90 in the z-axis direction should be so determined that, on having been deflected in the y-axis direction and having this deflection amplified as in FIG. 8, the beam will cross the xz-plane at or adjacent the midpoint of the protuberances 88 and 90 in the z-axis direction. With the distance L3 determined as above stated, the quadrupolar lens action will grow stronger with an increase in the height T, FIG. 5, of the protuberances 88 and 90, providing high rates of deflection magnification in both x- and y-axes directions.

Generally, the shorter the distance L3, the higher will be the deflection sensitivity in the y-axis direction at high deflection voltages, and vice versa. Also, with an increase in the height T of the protuberances 88 and 90, the image will suffer barrel distortion in the x-axis direction and pincushion distortion in the y-axis direction to a correspondingly greater extent, and the deflection sensitivity in the x-axis direction will become higher at high deflection voltages. These performance characteristics are controllable by changing the distance L3 and the length X1, FIG. 4, of each of the protuberances 88 and 90 in the x-axis direction.

Figure 9:
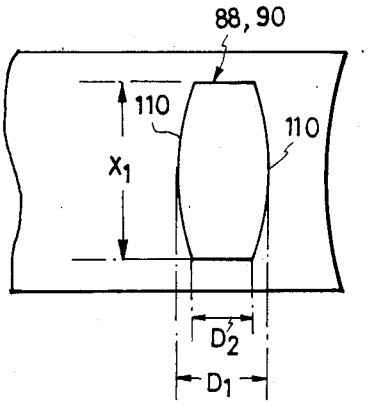
FIG. 9 is a fragmentary plan view explanatory of a possible variation in the shape of each protuberance of the lens system.
Figure 10:
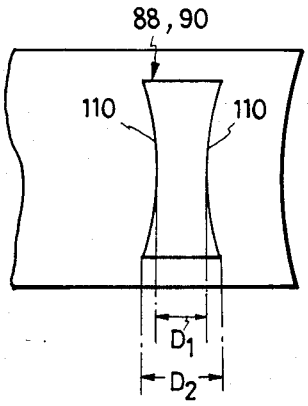
FIG. 10 is a similar view explanatory of another possible variation in the shape of each protuberance of the lens system.

Also, as shown in FIGS. 9 and 10, the pair of longitudinal sides 110, extending along the x-axis direction, of each protuberance 88 or 90 may be convexed as in FIG. 9 or concaved as in FIG. 10. The characteristics under consideration will be controlled by changing the relative dimensions D1 and D2 of the protuberances 88 and 90.

In the CRT 10 constructed in accordance with the foregoing teachings, we have succeeded in reducing the nonlinearity of the deflection factors in both vertical and horizontal directions to less than three percent on the screen sized eight by ten centimeters.

Embodiment of FIGS. 11–14

In FIGS. 11–14 is shown another preferred form of scan expansion lens system **46*a* for use in the CRT 10 of FIG. 1 in lieu of the lens system 46. The lens system 46*a* comprises two tubular electrodes 50 and 52*a* aligned about the z-axis of the CRT 10. The gun-side electrode 50 is essentially similar to that of the FIGS. 1–10 lens system 46, comprising the two pairs of opposite sides 60–66 and the pair of tongues 68 and 70 having the protuberances 88 and 90**.

The target-side electrode **52*a* differs from its counterpart 52 of the lens system 46 in having a pair of tongues 112 and 114 extending from the second pair of opposite sides 96 and 98 in coplanar relation thereto toward the gun-side electrode 50. The pair of tongues 68 and 70 of the gun-side electrode 50 and the pair of tongues 112 and 114 of the target-side electrode 52*a* are arranged in interdigitating relation to each other. Accordingly, in this lens system 46*a*, the two electrodes 50 and 52*a* may be considered to be disposed in end-to-end relation to each other, with a gap 116 therebetween which is sufficient to electrically insulate them from each other. The pair of tongues 68 and 70 of the gun-side electrode 50 are in coplanar relation to the first pair of opposite sides 92 and 94, respectively, of the target-side electrode 52*a*, and so are the pair of tongues 112 and 114 of the target-side electrode to the second pair of opposite sides 64 and 66**, respectively, of the gun-side electrode.

Figure 12:
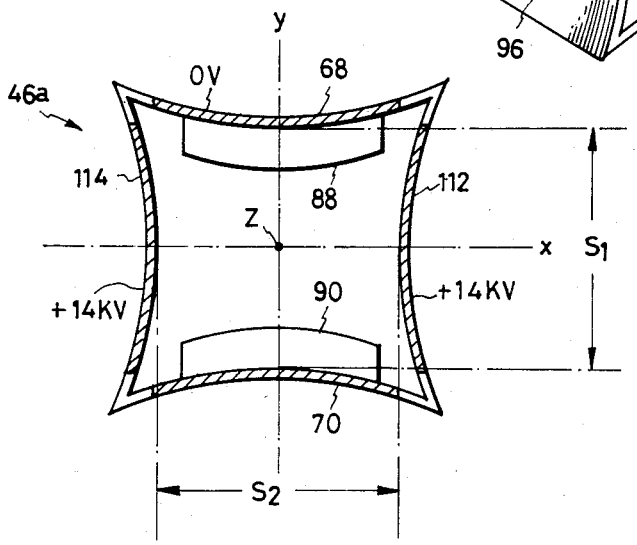
FIG. 12 is a cross section through the lens system of FIG. 11, taken along the line XII—XII in FIG. 13.
Figure 13:
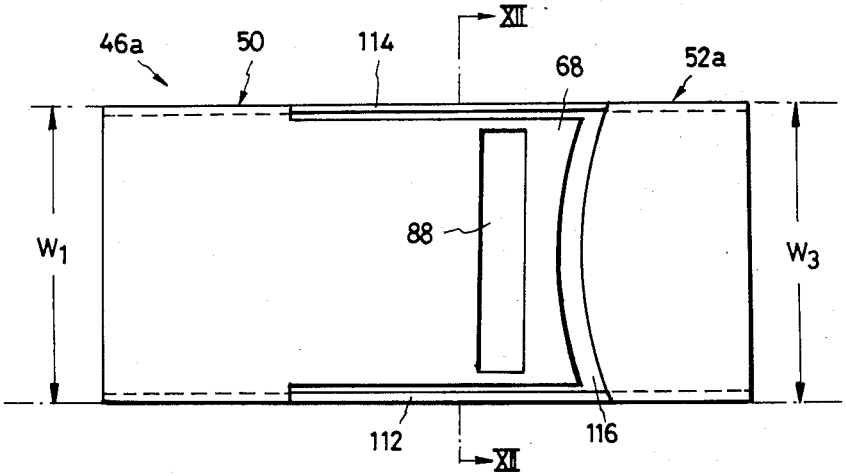
FIG. 13 is a plan view of the lens system of FIG. 11.
Figure 14:
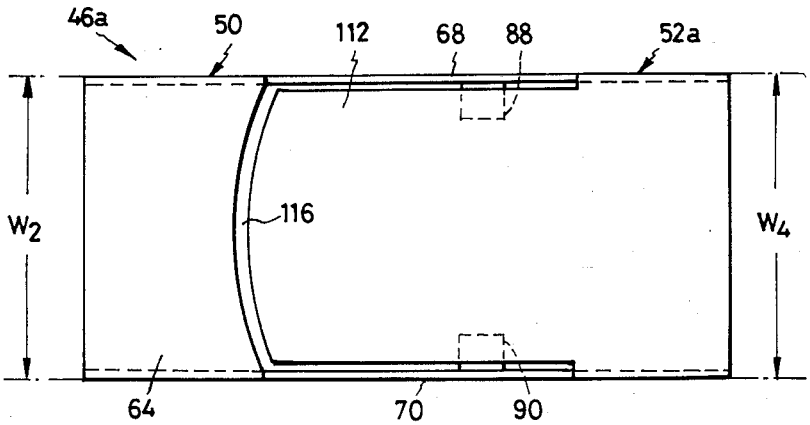
FIG. 14 is a side elevation of the lens system of FIG. 11.
Figure 15:
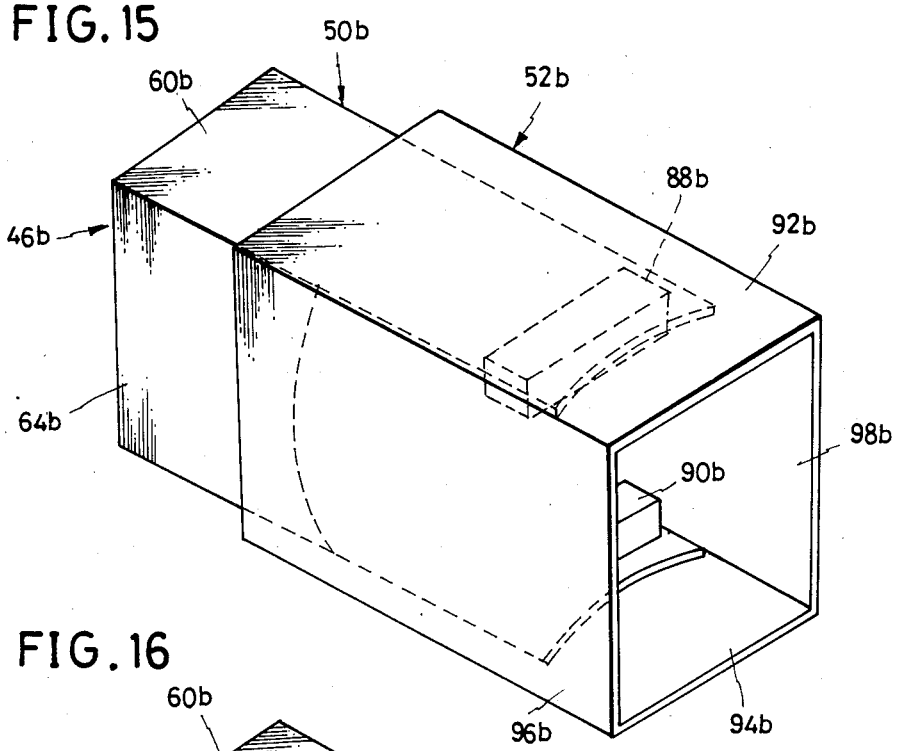
FIG. 15 is a perspective view of still another preferred form of the scan expansion lens system embodying our invention.
Figure 16:
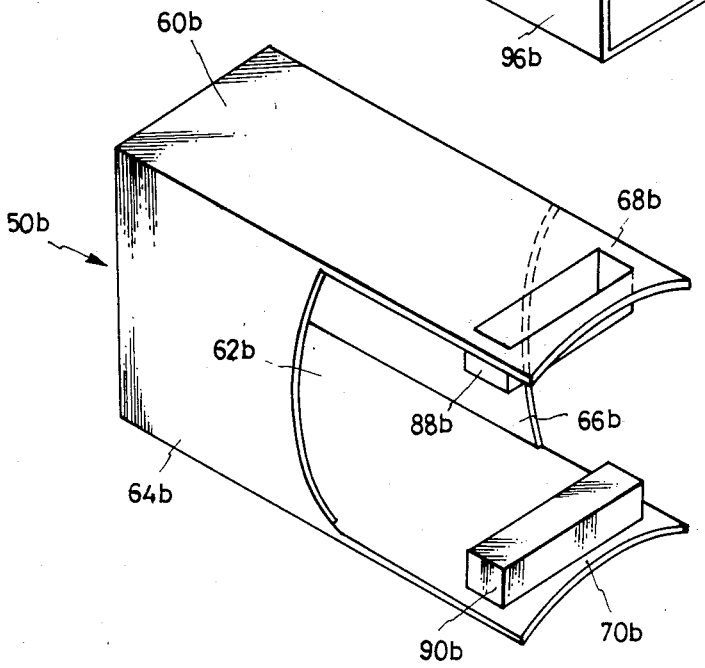
FIG. 16 is a perspective view of the gun-side electrode of the lens system of FIG. 15.
Figure 17:
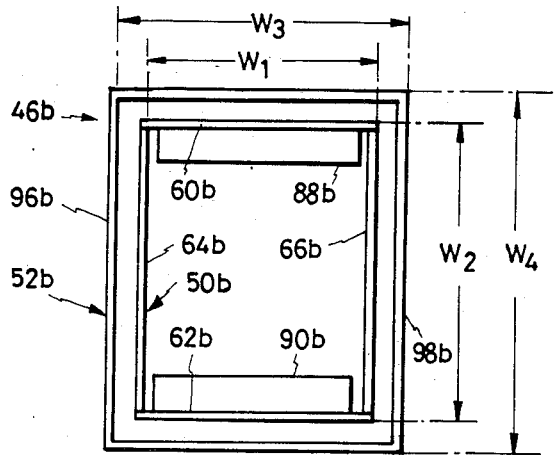
FIG. 17 is an end elevation ofo the lens system of FIG. 15, the view being explanatory of the relative dimensions of the two electrodes of the lens system.
Figure 18:
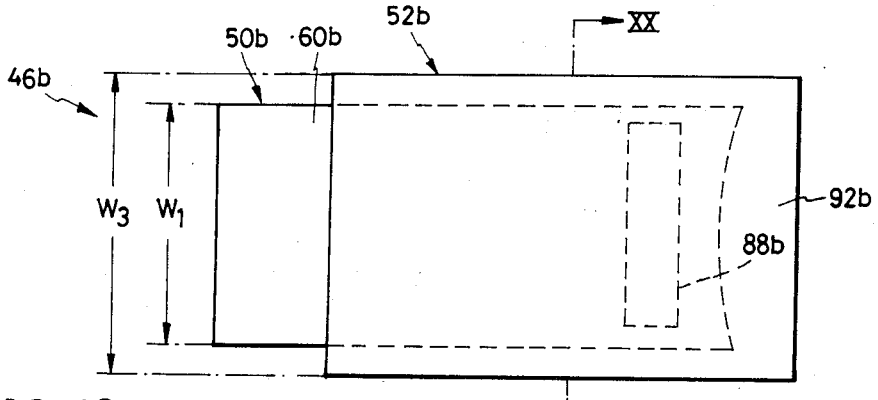
FIG. 18 is a plan view of the lens system of FIG. 15, the vew being also explanatory of the relative dimensions of the two electrodes of the lens system.
Figure 19:
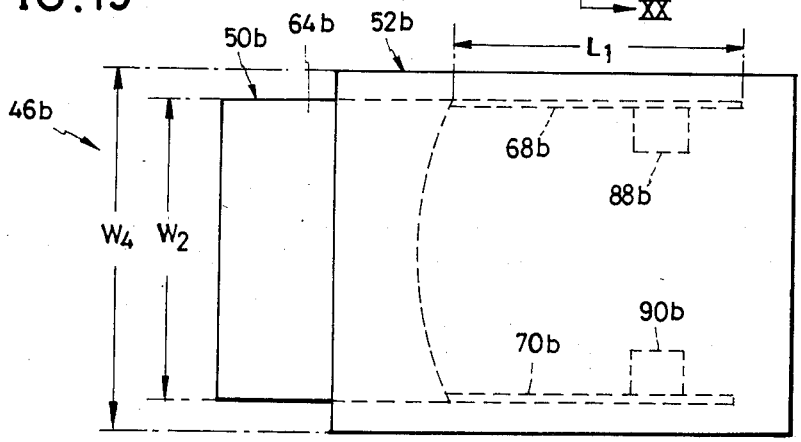
FIG. 19 is a side elevation of the lens system of FIG. 15, the view being also explanatory of the relative dimensions of the two electrodes of the lens system.

With the two electrode 50 and **52*a* configured and arranged as in the foregoing, there is, as shown in FIG. 12, a space defined by the two interdigitating pairs of tongues 68 and 70, and 112 and 114, of the two electrodes. Since the dimensions W1, W2, W3 and W4 are all equal as aforesaid, the spacing S1 on the yz-plane between the first pair of tongues 68 and 70 is equal to the spacing S2 on the xz-plane between the second pair of tongues 112 and 114**.

This lens system **46*a* is symmetrical with respect to both xz- and yz-planes, so that the space bounded by the two interdigitating pairs of tongues 68, 70, 112 and 114 as in FIG. 12 provides an ideal quadrupolar lens field described previously with reference to FIG. 6. The performance characteristics of this lens system 46*a* are therefore analogous with those set forth in connection with the FIGS. 1–10 lens system 46**.

Embodiment of FIGS. 15–20

Still another preferred form of scan expansion lens system **46*b* shown in FIGS. 15–20 differs from the FIGS. 1–10 lens system 46 in that the four sides 60*b*, 62*b*, 64*b* and 66*b*, as well as the pair of tongues 68*b* and 70*b*, of a gun-side electrode 50*b* and the four sides 92*b*, 94*b*, 96*b* and 98*b* of a target-side electrode 52*b* are all exactly flat and parallel to either the xz- or yz-plane. This lens system 46*b* can be identical in the other constructional details with the lens system 46**.

Figure 20:
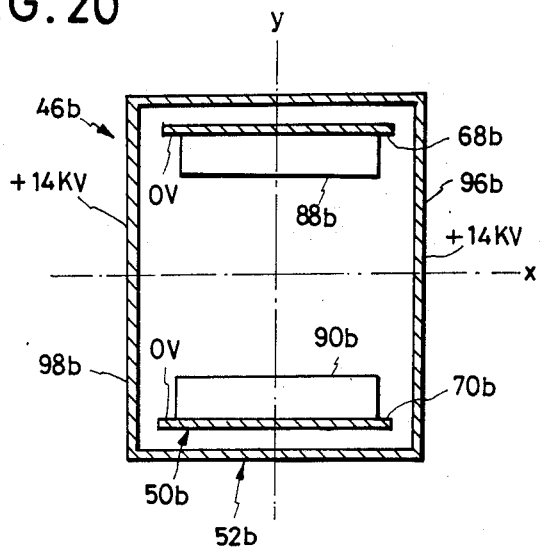
FIG. 20 is a cross section through the lens system of FIG. 15, taken along the line XX—XX in FIG. 18.

Further, as indicated in FIGS. 17–20, the length L1 of the pair of tongues **68*b* and 70*b* and the widths W1, W2, W3 and W4 of the sides 60*b*–66*b* and 92*b*–98*b* of the electrodes 50*b* and 52*b* can be determined in accordance with the teachings of the FIGS. 1–10 lens system 46. A semiideal quadrupolar lens field will then be created in the space bounded by the pair of tongues 68*b* and 70*b*, complete with the protuberances 88*b* and 90*b*, of the gun-side electrode 50*b* and the second pair of opposite sides 96*b* and 98*b* of the target-side electrode 52*b*, as illustrated in FIG. 20. The operation of this lens system 46*b* is therefore self-evident from above described operation of the FIGS. 1–10 lens system 46**.

Figure 22:
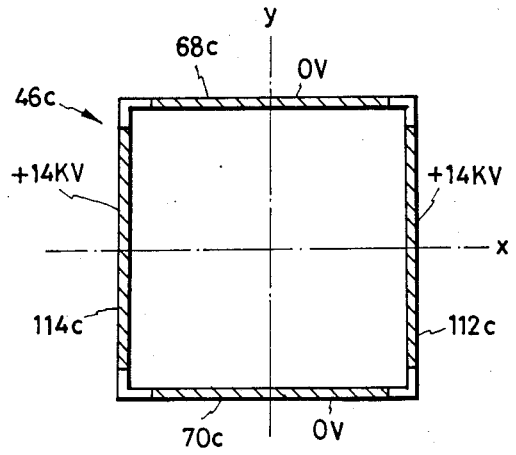
FIG. 22 is a cross section through the lens system of FIG. 21.
Figure 21:
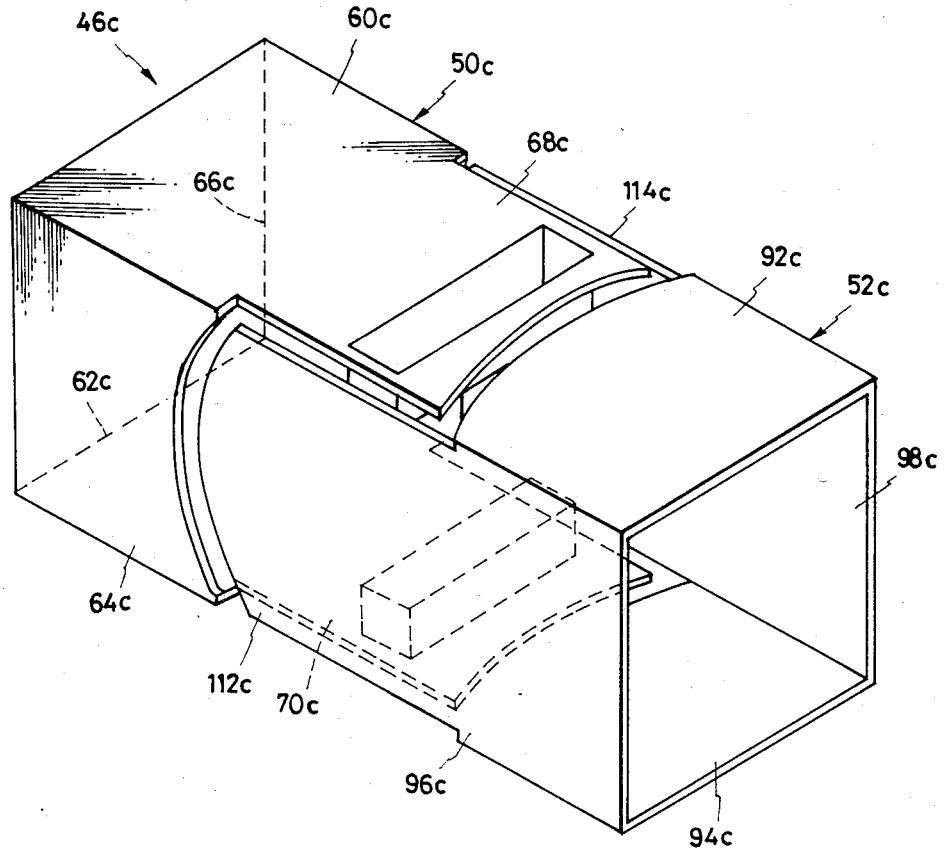
FIG. 21 is a perspective view of a further preferred form of the scan expansion lens system embodying our invention.

Embodiment of FIGS. 21–22

A further preferred form of scan expansion lens system **46*c* shown in FIG. 21 is a slight modification of the FIGS. 11–14 lens system 46*a*. The modification resides in the fact that the four sides 60c, 62c, 64c and 66c, as well as the pair of tongues 68c and 70c, of a gun-side electrode 50c and the four sides 92c, 94c, 96c and 98c, as well as the pair of tongues 112c and 114c, of a target-side electrode 52c are all exactly flat and parallel to either the xz- or yz-plane. This lens system 46c is identical in the other constructional details with the lens system 46a. Its operation is also analogous with that of the lens system 46a, a semi-ideal quadrupolar lens field being created in the space bounded by the two interdigitating pairs of flat tongues 68c, 70c, 112c and 114c as in FIG. 22**.

Embodiment of FIGS. 23–27

Figure 23:
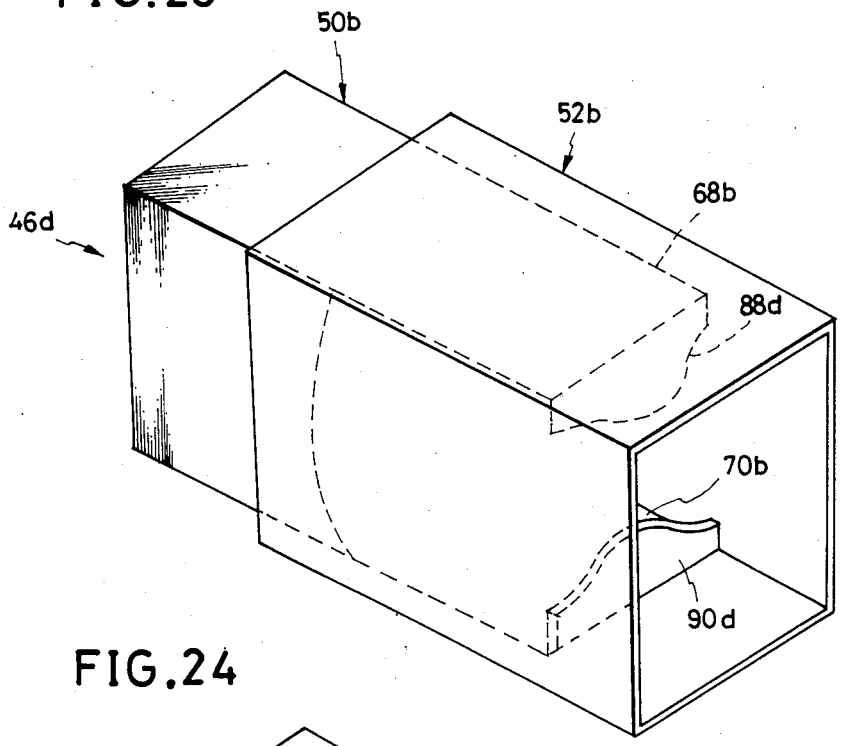
FIG. 23 is a perspective view of a further preferred form of the scan expansion lens system embodying our invention.
Figure 24:
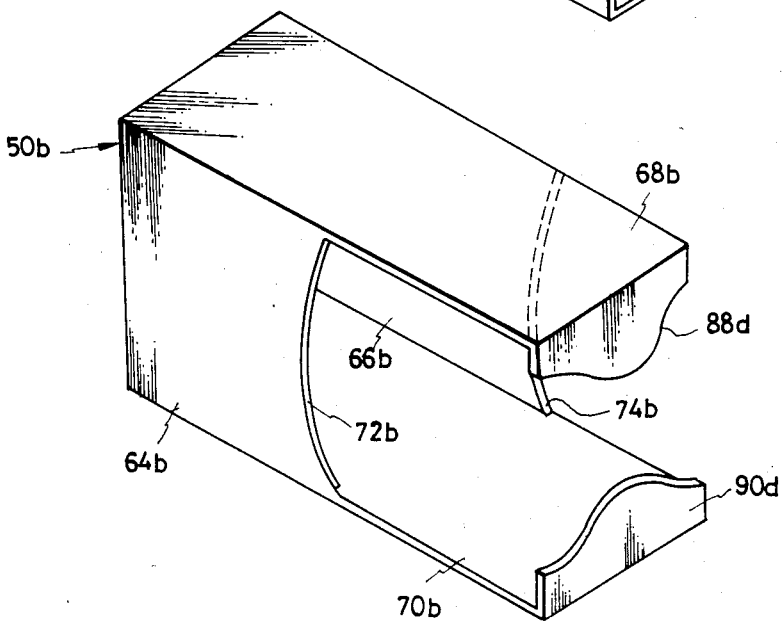
FIG. 24 is a perspective view of the gun-side electrode of the lens system of FIG. 23.
Figure 25:
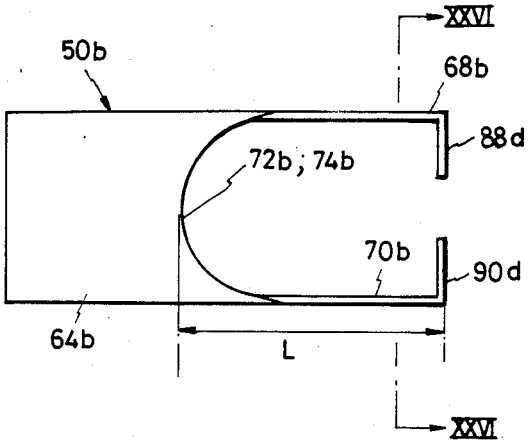
FIG. 25 is a side elevation of the gun-side electrode of the lens system of FIG. 23.

FIG. 23 shows a further preferred form of scan expansion lens system 46d which is akin to the FIGS. 15–20 lens system 46b except for a pair of protuberances 88d and 90d. As better illustrated in FIGS. 24 and 25, these protuberances 88d and 90d are both formed by bending target-side end portions of the pair of tongues 68b and 70b toward each other. The other constructional details of this lens system 46d are as previously set forth in connection with the FIGS. 15–20 lens system 46b. We will therefore identify the various parts of this lens system 46d by the same reference characters as used to denote the corresponding parts of the lens system 46b.

The pair of protuberances 88d and 90d are also effective to intensify the quadrupolar lens action offered by this lens system, contributing toward higher deflection magnification rates in both vertical and horizontal directions. We have further found that the shape of these protuberances significantly affects both deflection magnification rates in both directions and the linearity of deflection factors in both directions.

Figure 26:
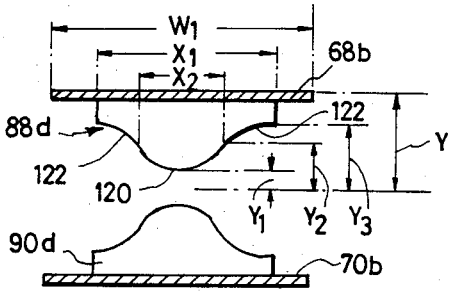
FIG. 26 is a cross section through the gun-side electrode of the lens system of FIG. 23, taken along the line XXVI—XXVI in FIG. 25 and showing a possible variation in the shape of the protuberances.
Figure 27:
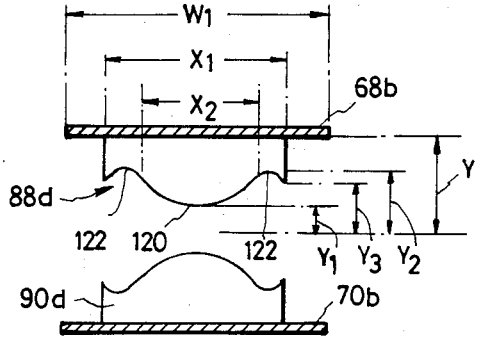
FIG. 27 is a view similar to FIG. 26 but showing another possible variation in the shape of the protuberances.

As seen in the z-axis direction as in FIGS. 26 and 27, each protuberance 88d, 90d has a midportion 120, wherein shown to be convex, and a pair of side portions 122, herein shown to be concave, on both sides of the midportion. Let X1 be the dimension of each protuberance along the x-axis; X2 the dimension of the midportion 120 of each protuberance along the x-axis; Y1 the distance between the xz-plane and the apex of the midportion of each protuberance; Y2 the distance between the xz-plane and the boundaries between the midportion and side portions of each protuberance; Y3 the distance between the xz-plane and the extremities of each protuberance; Y the distance between the xz-plane and each tongue 68b or 70b; and L (FIG. 25) the distance between the protuberances 88d and 90d and the midpoint of the concave target-side ends 72b and 74b of the second pair of opposite sides 64b and 66b of the gun-side electrode 50b.

If the dimension L is so determined that the electron beam that has been deflected in the y-axis direction will cross the xz-plane in the neighborhood of the protuberances 88d and 90d, then the quadrupolar lens action in the neighborhood of these protuberances will become stronger with a decrease in the distance Y1. Generally, the shorter the dimension L, the higher will be the deflection sensitivity in the y-axis direction at high deflection voltages, and vice versa. An increase in the intensity of the quadrupolar lens action and, therefore, in the rates of deflection amplification takes place with a decrease in the distance Y1. A decrease in the distance Y1 also leads to a decrease in deflection sensitivities in both directions at high deflection voltages, and to the barrel distortion of the display in the x-axis direction and to the pincushion distortion of the display in the y-axis direction.

With these relations between the geometries of the protuberances 88d and 90d and the performance characteristics of the lens system 46d in mind, the dimensions and distances L, Y, Y1, Y2, Y3, X1 and X2 specified in connection with FIGS. 26 and 27 may be determined for an optimum set of performance characteristics. As will be noted from a comparison of FIGS. 26 and 27, the protuberances 88d and 90d can take a variety of different shapes. Although we have shown the opposed edges of the protuberances 88d and 90d as each consisting of the midportion 120 and pair of side portions 122, the shapes of these edges can, in fact, be composed of one to three curves of constant or varying radii or straight lines, provided that they are of bilateral symmetry with respect to the zx-plane.

Figure 28:
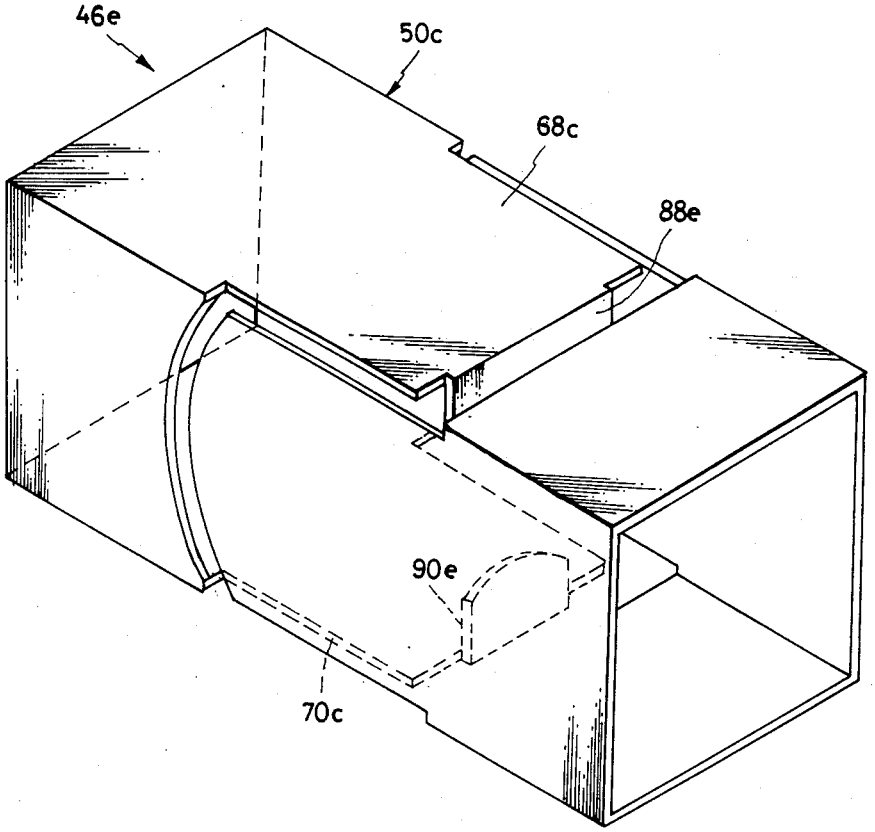
FIG. 28 is a perspective view of a further preferred form of the scan expansion lens system embodying our invention.

Embodiment of FIG. 28

FIG. 28 shows a slight modification 46e of the FIGS. 21–22 lens system 46c. The modified lens system 46e features a pair of protuberances 88e and 90e formed by bending target-side end portions of the pair of tongues 68c and 70c of the gun-side electrode 50c. The other details of construction and performance characteristics of this lens system 46e are as set forth in conjunction with the FIGS. 21–22 lens system 46c.

Figure 29:
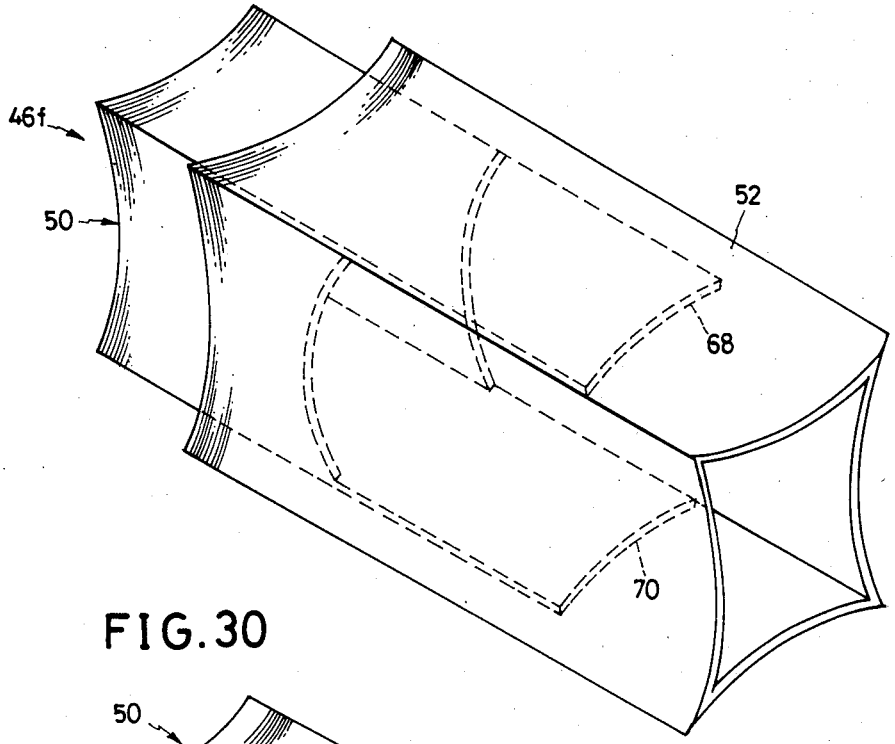
FIG. 29 is a perspective view of a further preferred form of the scan expansion lens system embodying our invention.
Figure 30:
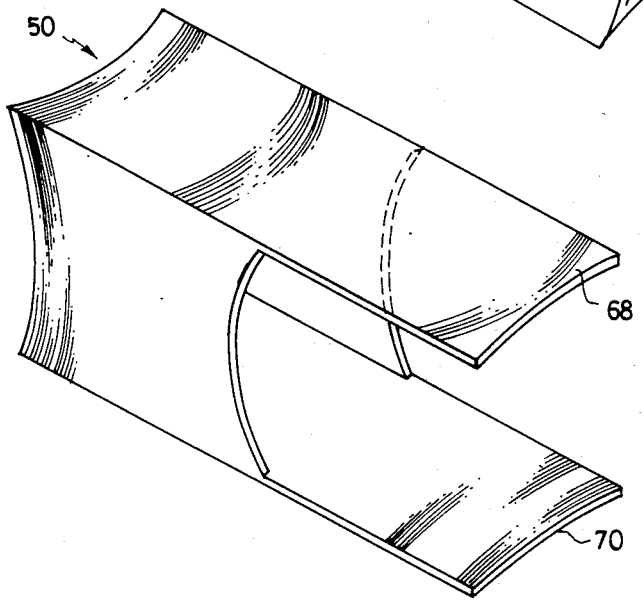
FIG. 30 is a perspective view of the gun-side electrode of the lens system of FIG. 29.

Embodiment of FIGS. 29–30

FIGS. 29 and 30 show a slight modification 46f of the FIGS. 1–10 lens system 46. As will be noted upon comparison of FIGS. 29 and 30 with FIGS. 2 and 3, the modified lens system 46f differs from the lens system 46 in not having the pair of probuerances on the tongues 68 and 70 of the gun-side electrode 40. Such protuberances are dispensable, as in this embodiment, depending upon the rates of scan expansion sought to be attained. Although we have shown the other structural details of this lens system 46f to be identical with those of the FIGS. 1–10 lens system 46, it will be understood that the pair of protuberances can be omitted from all the other embodiments set forth in the foregoing.

Figure 31:
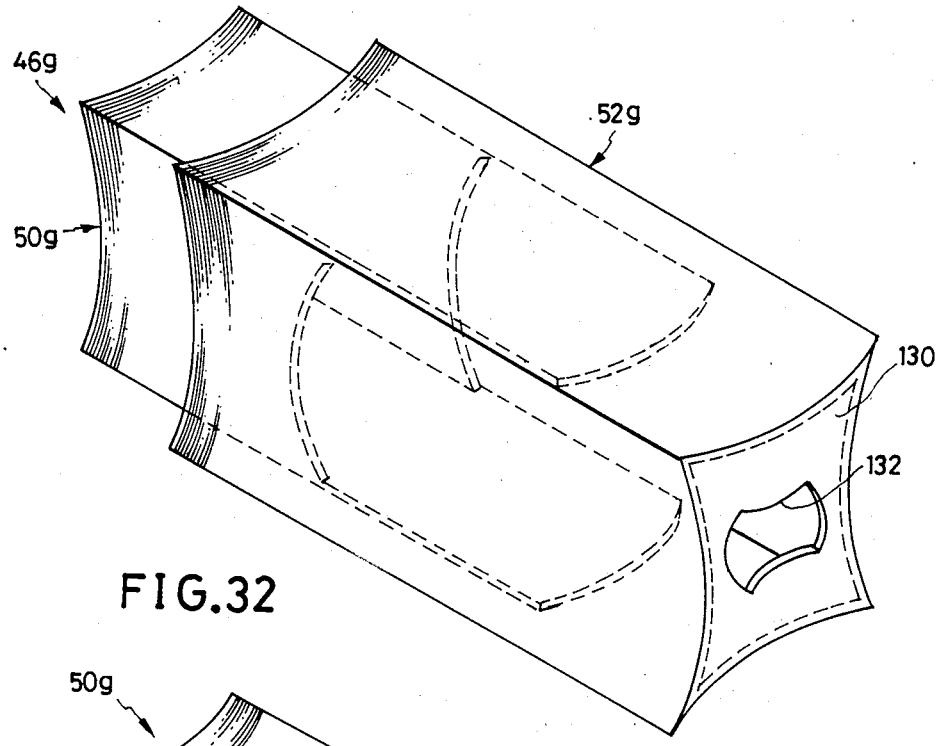
FIG. 31 is a perspective view of a further preferred form of the scan expansion lens system embodying our invention.
Figure 32:
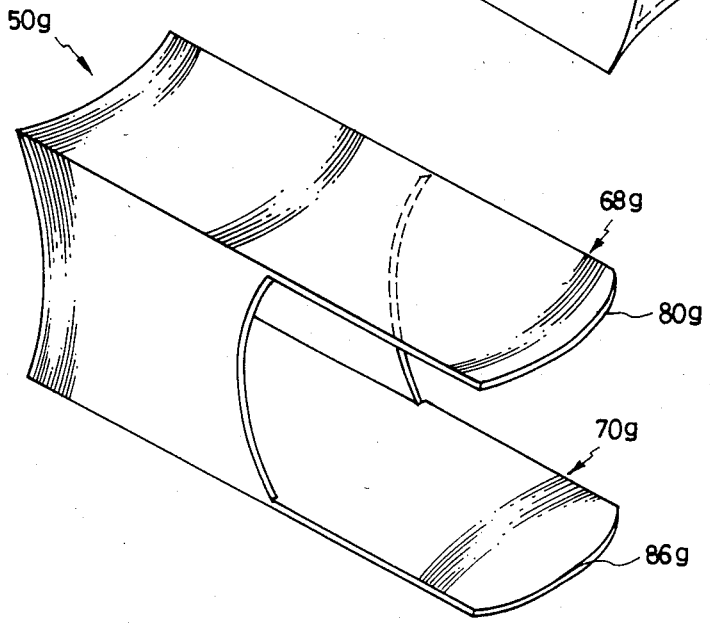
FIG. 32 is a perspective view of the gun-side electrode of the lens system of FIG. 31.
Figure 33:
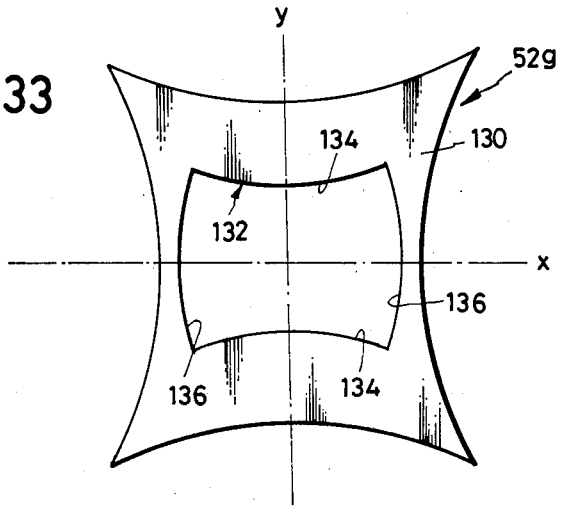
FIG. 33 is a target-side end elevation of the lens system of FIG. 31 and showing in particular the apertured end plate.

Embodiment of FIGS. 31–33

In FIGS. 31–33 is shown a further preferred form of scan expansion lens system 46g in accordance with our invention, comprising a gun-side electrode 50g and a target-side electrode 52g. This lens system 46g is similar to the FIGS. 29–30 lens system 46f in having no protuberances on a pair of tongues 68g and 70g of the gun-side electrode 50g. A feature of this lens system 46g is that the target-side end of the target-side electrode 52g is closed by a welded-on end plate 130 having an aperture 132 defined therein.

As illustrated on a somewhat enlarged scale in FIG. 33, the aperture 132 in the endplate 130 is bounded by a first pair of opposite edges 134 generally extending along the x-axis and a second pair of opposite sides 136 generally extending along the y-axis. The first pair of opposite sides 134 are convexed toward each other whereas the second pair of opposite sides 136 are concave.

The lens system 46g is similar in the other details of construction to the FIGS. 29–30 lens system 46f except that the target-side ends 80g and 86g of the tongues 68g and 70g are both convexed toward the target. We will later refer to these convex ends of the tongues 68g and 70g.

The same potential is applied to the target-side electrode 52g of this lens system 46g as to the postaccelerating electrode 48, FIG. 1, as in the first described embodiment. Therefore, owing to the potential difference between the two electrodes 50g and 52g, divergent lens actions for both x- and y-axes directions are created at and adjacent the aperture 132 in the end plate 130. The quadrupolar lens action may be intensified by making the pair of tongues 68g and 70g suitably long and by convexing their target-side ends 80g and 86g toward the target. The resulting pincushion distortion of the image in the x-axis direction can be compensated for by the divergent lens actions created by the apertured end plate 130.

We could provide the apertured end plate of this lens system 46g at the target-side end of the target-side electrode of any of the other preferred forms of lens systems disclosed herein, regardless of whether or not such lens systems have the pair of protuberances on the tongues.

Figure 34:
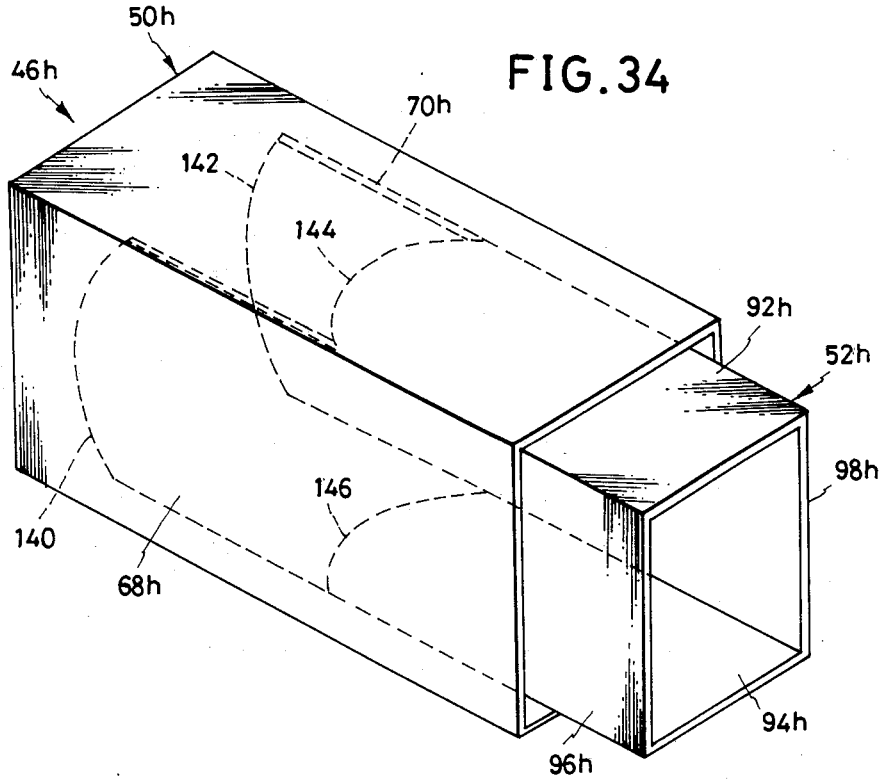
FIG. 34 is a perspective view of a further preferred form of the scan expansion lens system embodying our invention.

Embodiment of FIG. 34

A further preferred form of scan expansion lens system 46h shown in FIG. 34 differs from all the foregoing embodiments in that a pair of tongues 68h and 70h are formed by coplanar extensions of the second pair of opposite sides 96h and 98h of the target-side electrode 52h toward the gun 26, FIG. 1. The gun-side ends 140 and 142 of these tongues 68h and 70h are curved in arcs that are convex toward the gun. The gun-side ends 144 and 146 of the first pair of opposite sides 92h and 94h are also curved in area that are convex toward the gun.

The gun-side electrode 50h of this lens system 46h is shown to be exactly boxlike in shape, with a cross sectional size larger than that of the target-side electrode 52h. The gun-side electrode 50h envelopes a gun-side end portion, including the pair of tongues 68h and 70h, of the target-side electrode 52h. The resulting performance characteristics of this lens system 46h are similar to those set forth in connection with the FIGS. 1–10 lens system 46.

As desired or required, the target-side end of the target-side electrode 52h of this lens system 46h may be closed by an apertured end plate similar to that shown at 130 in FIGS. 31 and 33. If the aperture in the end plate applied to this lens system 46h is shaped as shown in FIG. 33, the gun-side ends 144 and 146 of the first pair of opposite sides 92h and 94h of the target-side electrode 52h should be curved in arcs that are convex toward the target, rather than toward the gun as shown in FIG. 34.

Figure 35:
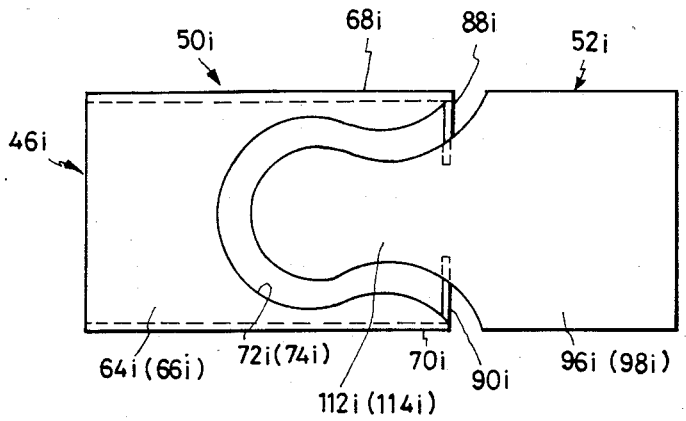
FIG. 35 is a side elevation of a further preferred form of the scan expansion lens system embodying our invention.

Embodiment of FIG. 35

Figure 11:
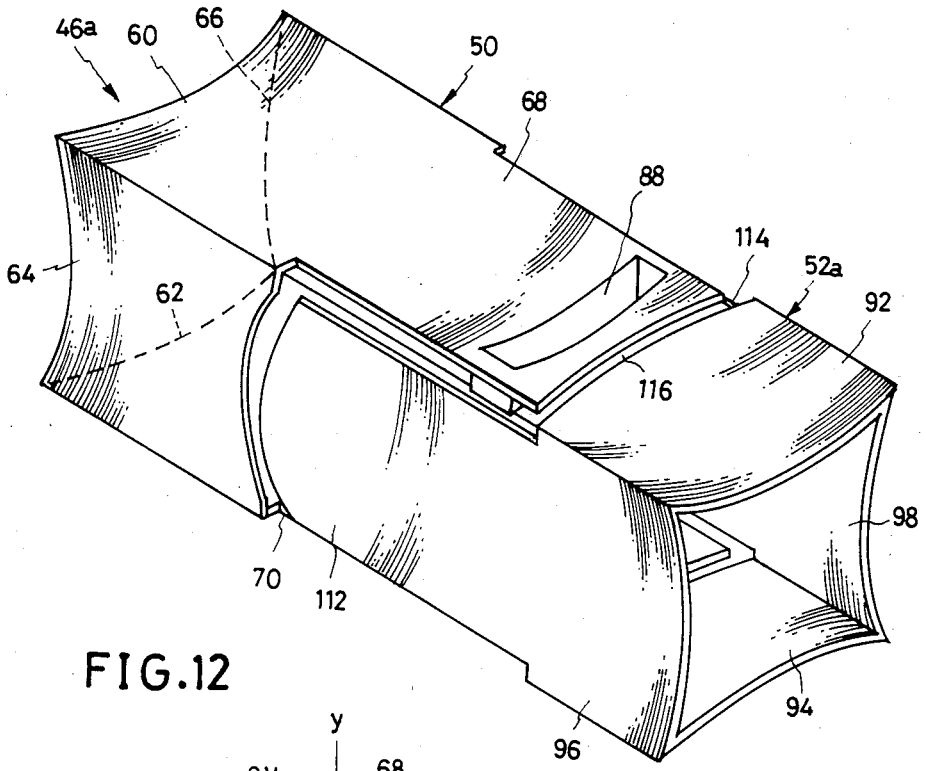
FIG. 11 is a perspective view of another preferred form of the scan expansion lens system embodying our invention.

FIG. 35 shows a further preferred form of scan expansion lens system 46i, comprising a gun-side electrode 50i and a target-side electrode 52i of approximately the same cross sectional size held in end-to-end arrangement as in the lens systems 46a, 46c and 46e of FIGS. 11, 21 and 28, respectively. Also as in these foregoing lens systems the lens system 46i has a second pair of tongues 112i (114i) extending toward the gun from the second pair of opposite sides 96i (98i) of the target-side electrode 52i. The shape of these tongues 112i (114i) is defined by two or more different curves, which may be either convex or concave, and the target-side ends 72i (74i) of the second pair of opposite sides 64i (66i) are shaped in conformity with the shape of the tongues 112i (114i). These complementary shapes of the tongues 112i (114i) and ends 72i (74i) may be resorted to as required for the correction of image distortions.

We have shown the pair of protuberances 88i and 90i of this lens system 46i as being formed by bending the first pair of tongues 68i and 70i, as in FIG. 28, by way of example only. Such protuberances could be formed by the pressing of the tongues as in FIGS. 3, 11 or 21. Indeed, the teachings of FIG. 35 are applicable to any other lens systems disclosed herein having the pair of tongues protruding from the target-side electrode.

Figure 36:
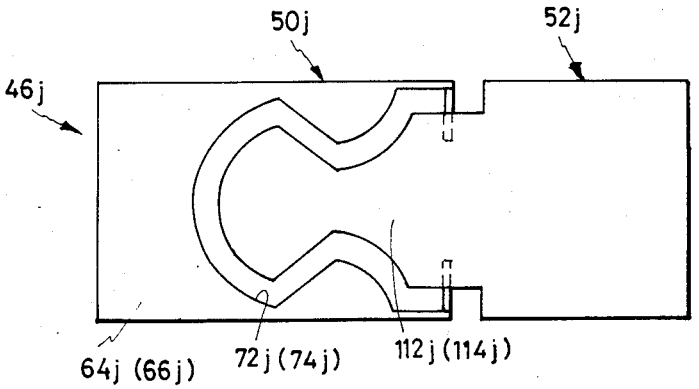
FIG. 36 is a side elevation of a further preferred form of the scan expansion lens system embodying our invention.

Embodiment of FIG. 36

In FIG. 36 is shown a slight modification 46j of the lens system 46i of FIG. 35. This lens system 46j is meant to illustrate the fact that the complementary shapes of the pair of tongues of the target-side electrode and the opposed ends of the second pair of opposite sides of the gun-side electrode need not necessarily be delineated by curves alone. Thus, in this lens system 46j, the pair of tongues 112j (114j) of the target-side electrode 52j and the target-side ends 72j (74j) of the second pair of opposite sides 64j (66j) of the gun-side electrode 50j are both shaped complementarily by combinations of curves and straight lines.

Possible Modifications

Although we have shown and described our invention in terms of several preferable embodiments thereof, we recognize, of course, that our invention could be embodied in other forms to conform to design preferences or system requirements. The following is a brief list of possible modifications of the embodiments disclosed herein which, we believe, all fall within the scope of our invention:

1. Some features of the various embodiments are interchangeable. Thus, for example, the pair of protuberances 88 and 90 of the FIGS. 1–10 lens system 46 or of the FIGS. 11–14 lens system 46a could be formed by bending the tongues of the gun-side electrode as in the FIGS. 23–27 lens system 46d or FIG. 28 lens system 46e. Similarly, the four sides of each electrode of the FIGS. 23–27 lens system 46d or of the FIG. 28 lens system 46e could be of concave cross section as in the FIGS. 1–10 lens system 46 or FIGS. 11–14 lens system 46a.

2. One, two or all of the quadrupolar lens systems 36, 38 and 42 of the CRT 10 are dispensable.

3. Different potentials could be applied to the target-side electrode of the scan expansion lens system and to the postaccelerating electrode of the CRT.

4. In the FIGS. 1–10 lens system 46 or the FIGS. 11–14 lens system 46a, the four sides of each electrode need not be wholly concaved as seen along the z-axis; instead, only midportions of such sides in the xy-plane may be concaved, with the other portions left flat.

5. The corners of the electrodes of the various lens systems may be rounded.

6. As seen along the z-axis, the four sides of the electrodes of the various lens systems may be shaped in circular, elliptical, parabolic arcs, instead of hyperbolic arcs.

What we claim is:

1. Apparatus including a cathode ray tube having a target, an electron gun for emitting a beam of electrons normally directed along a z-axis toward the target, deflection means disposed between the target and the electron gun for deflecting the beam in directions of x- and y-axes which are at right angles with each other and with the z-axis, and a scan expansion lens system disposed between the deflection means and the target for amplifying the deflections of the beam in both x- and y-axes directions, the scan expansion lens system comprising:

(a) first and second tubular electrodes of substantially rectangular cross sectional shape disposed in alignment with respect to the z-axis to allow the passage of the beam therethrough, the first and second electrodes being at least partly displaced from each other along the z-axis, with a sufficient gap between the first and second electrodes to provide electrical insulation therebetween;

(b) the first electrode having a first pair of opposite sides which are symmetrical with respect to an xz-plane determined by the x- and z-axes, and a second pair of opposite sides which are symmetrical with respect to a yz-plane determined by the y- and z-axes;

(c) the second electrode having a first pair of opposite sides which are symmetrical with respect to the xz-plane, and a second pair of opposite sides which are symmetrical with respect to the yz-plane;

(d) at least either of the first pair of opposite sides of the first electrode and the second pair of opposite sides of the second electrodes having extensions therefrom toward the other of the first and second electrodes to provide a pair of tongues;

(e) each of the spacing between the first pair of opposite sides of the first electrode as measured on the yz-plane and the spacing between the second pair of opposite sides of the second electrode as measured on the xz-plane being from 80 to 120 percent of the other;

(f) the apparatus further including means for applying such prescribed electric potentials to the first and second electrodes of the lens system that the electron beam on being deflected by the deflection means in one of the x- and y-axis directions has its deflection amplified by having its traveling direction inverted with respect to the z-axis by a quadrupolar lens action of the first and second electrodes, whereas the electron beam on being deflected in the other of the x- and y-axis directions has its deflection amplified by the quadrupolar lens action without having its traveling direction inverted.

2. The apparatus of claim 1 wherein the first electrode of the lens system is disposed closer to the electron gun than is the second electrode, wherein the first pair of opposite sides of the first electrode have the extensions toward the target to provide the pair of tongues, and wherein the second electrode envelopes at least the pair of tongues of the first electrode.

3. The apparatus of claim 2 wherein the pair of tongues and the second pair of opposite sides of the first electrode have target-side ends directed toward the target, and wherein the distance along the z-axis between the target-side end of each tongue and the target-side end of each of the second pair of opposite sides of the first electrode is from 80 to 120 percent of the dimension along the y-axis of each of the second pair of opposite sides of the first electrode.

4. The apparatus of claim 2 wherein the pair of tongues have surfaces opposed to each other, and wherein the lens system further comprises a pair of protuberances formed on the opposed surfaces of the tongues for intensifying the deflection amplifying capabilities of the lens system in both x- and y-axes directions.

5. The apparatus of claim 4 wherein each protuberance is elongated along the x-axis.

6. The apparatus of claim 4 wherein the pair of tongues have target-side end portions bent toward each other to provide the pair of protuberances.

7. The apparatus of claim 1 wherein the first electrode of the lens system is disposed closer to the electron gun than is the second electrode, wherein the first pair of opposite sides of the first electrode have extensions toward the target to provide the pair of tongues, and wherein the second pair of opposite sides of the second electrode have extensions toward the gun to provide a second pair of tongues, the first recited and second pairs of tongues being disposed in interdigitating relation to each other.

8. The apparatus of claim 7 wherein the first pair of tongues have surfaces opposed to each other, and wherein the lens system further comprises a pair of protuberances formed on the opposed surfaces of the first pair of tongues for intensifying the deflection amplifying capabilities of the lens system in both x- and y-axes directions.

9. The apparatus of claim 8 wherein each protuberance is elongated along the x-axis.

10. The apparatus of claim 8 wherein the first pair of tongues have target-side end portions bent toward each other to provide the pair of protuberances.

11. The apparatus of claim 1 wherein the first electrode of the lens system is disposed closer to the electron gun than is the second electrode, wherein the second pair of opposite sides of the second electrode have extensions toward the gun to provide the pair of tongues, and wherein the first electrode envelopes at least the pair of tongues of the second electrode.

12. The apparatus of claim 1 wherein the second electrode of the lens system is disposed closer to the target than is the first electrode and has a target-side end oriented toward the target, and wherein the lens system further comprises an end plate closing the target-side end of the second electrode, the end plate having defined therein an aperture for the passage of the beam from the gun toward the target.

13. The apparatus of claim 12 wherein the aperture in the end plate of the second electrode is defined by a first pair of opposite edges curved in arcs that are convex toward the xz-plane and by a second pair of opposite edges curved in arcs that are convex away from the yz-plane.

14. The apparatus of claim 1 wherein the first and second pairs of opposite sides of the first and second electrodes are each at least partly convex toward the z-axis as seen along the z-axis.

15. The apparatus of claim 1 wherein the first and second pairs of opposite sides of the first and second electrodes are each flat.

16. The apparatus of claim 1 wherein the potential-applying means apply substantially the same potential to the second electrode of the lens system as to the target.

* * * * *

UNITED STATES PATENT AND TRADEMARK OFFICE

CERTIFICATE OF CORRECTION

PATENT NO. : 4,754,191

DATED : Jun. 28, 1988

INVENTOR(S) : Osamu Akizuki and Takefumi Kato

It is certified that error appears in the above-identified patent and that said Letters Patent is hereby corrected as shown below:

Col. 9, line 52, change "within" to -- without --.

Col. 11, line 20, change "te" to -- the --.

Col. 11, line 21, change "of" to -- or --.

Col. 15, line 31, change "area" to -- arcs --.

Signed and Sealed this

Twenty-first Day of March, 1989

*Attest:*

DONALD J. QUIGG

*Attesting Officer*

*Commissioner of Patents and Trademarks*